US008556662B2

(12) United States Patent
Wang et al.

(10) Patent No.: US 8,556,662 B2
(45) Date of Patent: Oct. 15, 2013

(54) CARD CONNECTOR

(75) Inventors: Hung-Chi Wang, New Taipei (TW); Te-Hung Yin, New Taipei (TW)

(73) Assignee: Proconn Technology Co., Ltd., New Taipei (TW)

( * ) Notice: Subject to any disclaimer, the term of this patent is extended or adjusted under 35 U.S.C. 154(b) by 180 days.

(21) Appl. No.: 13/308,821

(22) Filed: Dec. 1, 2011

(65) Prior Publication Data

US 2013/0143443 A1 Jun. 6, 2013

(51) Int. Cl.
*H01R 24/00* (2011.01)

(52) U.S. Cl.
USPC ..... 439/630; 439/862; 439/325

(58) Field of Classification Search
USPC ..... 439/637, 636, 214, 216, 515, 326, 439/541.5, 540.1, 733.1, 630, 862, 79, 80
See application file for complete search history.

(56) References Cited

U.S. PATENT DOCUMENTS

| | | | | |
|---|---|---|---|---|
| 6,095,827 | A * | 8/2000 | Dutkowsky et al. | 439/83 |
| 6,210,194 | B1 * | 4/2001 | Choy | 439/326 |
| 6,464,521 | B1 * | 10/2002 | Kurotori et al. | 439/260 |
| 8,425,252 | B2 * | 4/2013 | Cai | 439/541.5 |
| 8,449,322 | B2 * | 5/2013 | Cai | 439/541.5 |
| 8,449,334 | B2 * | 5/2013 | Wang | 439/630 |

* cited by examiner

*Primary Examiner* — Dac D Ta
*Assistant Examiner* — Harshad Patel
(74) *Attorney, Agent, or Firm* — WPAT, P.C.; Anthony King

(57) ABSTRACT

A card connector includes an insulating housing defining a card recess, first electrical terminals and second electrical terminals disposed in the insulating housing. Each first electrical terminal has a base strip, a first fixing arm, a first elastic arm extending forward and inclining upward from the first fixing arm, a second elastic arm slantwise extending forward and upward from a substantial middle of the base strip and apart located under the first elastic arm, and a contact portion protruding upward from a front end of the base strip and apart located under the second elastic arm. A distal end of the first elastic arm elastically stretches upward into the card recess, and can be pressed downward to resist against the second elastic arm so as to make the second elastic arm further contact with the contact portion when an electronic card is inserted into the card recess.

7 Claims, 3 Drawing Sheets

CARD CONNECTOR

BACKGROUND OF THE INVENTION

1. Field of the Invention

The present invention relates to a card connector, and more particularly to a card connector capable of ensuring a steady connection between electrical terminals thereof and an electronic card.

2. The Related Art

With rapid development of digital technology, a variety of digital electronic products, such as digital cameras and cell phones, have been widely used in our daily life. In order to increase memory space and expand performance of the digital electronic products, the digital electronic products always dispose electronic cards therein. So, various card connectors are widely used in the digital electronic products for receiving the electronic cards therein to realize an electrical connection and an information transmission between the corresponding digital electronic product and the electronic card.

In general, the card connector includes an insulating housing defining a card recess for receiving an electronic card therein, and a plurality of electrical terminals of which each has a fastening portion fastened in the insulating housing, an elastic portion curvedly extending from one end of the fastening portion to project into the card recess, a contact portion protruding from the other end of the fastening portion to be apart located under the elastic portion, and a soldering portion extending from the fastening portion to project out of the insulating housing. In use, the electronic card is inserted into the card recess and presses the elastic portion to contact with the contact portion so as to achieve an electrical connection between the electronic card and the contact portion via the elastic portion. However, when the card connector is shaken or the electronic card is pulled out of the card connector, a short disconnection easily happens between the electronic card and the electrical terminals on account of a poor normal contact force of the elastic portion.

SUMMARY OF THE INVENTION

Accordingly, an object of the present invention is to provide a card connector including an insulating housing, a plurality of first electrical terminals and a plurality of second electrical terminals. The insulating housing has a front side thereof recessed rearward to form a card recess for receiving an electronic card therein. The insulating housing defines a plurality of first terminal fillisters and a plurality of second terminal fillisters communicating with the card recess. The first electrical terminal has a base strip extending along a front-to-rear direction, a first fixing arm extending upward from a rear end of the base strip, a first elastic arm extending forward from a lower portion of the first fixing arm and inclined upward in the process of extending forward with a distal end thereof bending downward, a second elastic arm slantwise extending forward and upward from a substantial middle of the base strip with a distal end thereof apart located under that of the first elastic arm, a contact portion protruding upward from a front end of the base strip and apart located under the distal end of the second elastic arm, and a soldering arm protruding downward from a front of the base strip. The base strip and an upper portion of the first fixing arm are held in the first terminal fillister. The first elastic arm, the second elastic arm and the contact portion are accommodated in the first terminal fillister with the distal end of the first elastic arm elastically stretching upward into the card recess. The soldering arms project outside the insulating housing. The second electrical terminals are disposed in the second terminal fillisters of the insulating housing respectively, and each has a third elastic arm of which a distal end projects downward into the card recess to resist against the electronic card. The electronic card inserted in the card recess presses the distal end of the first elastic arm of the first electrical terminal downward to resist against the distal end of the second elastic arm, so as to drive the distal end of the second elastic arm to contact with the contact portion.

As described above, in use, the electronic card is inserted into the card recess of the insulating housing and presses the distal end of the first elastic arm of the first electrical terminal downward to resist against the distal end of the second elastic arm, so as to drive the distal end of the second elastic arm to contact with the contact portion. So, an electrical connection is realized between the electronic card and the contact portion via the first elastic arm and the second elastic arm, and a short disconnection is avoided happening between the electronic card and the first electrical terminal on account of strong normal contact forces of the first elastic arm and the second elastic arm stood together even if the card connector is shaken or the electronic card is pulled out of the card connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
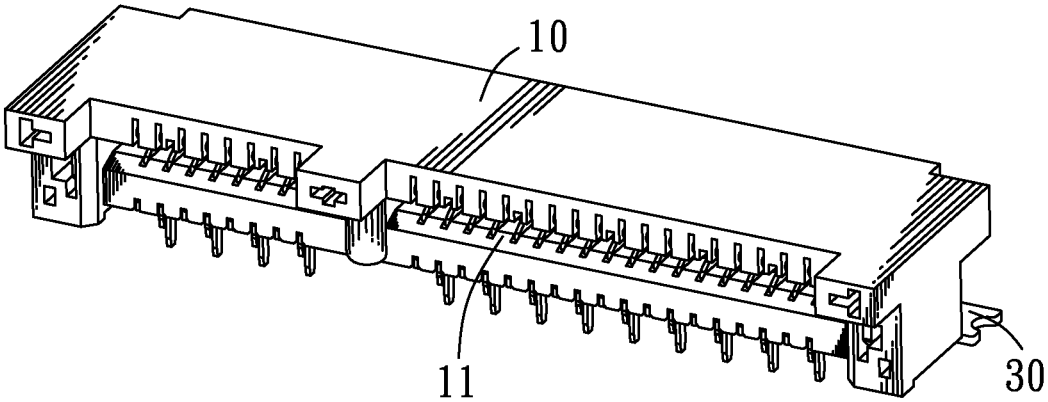
FIG. 1 is an assembled perspective view of a card connector in accordance with an embodiment of the present invention.
Figure 2:
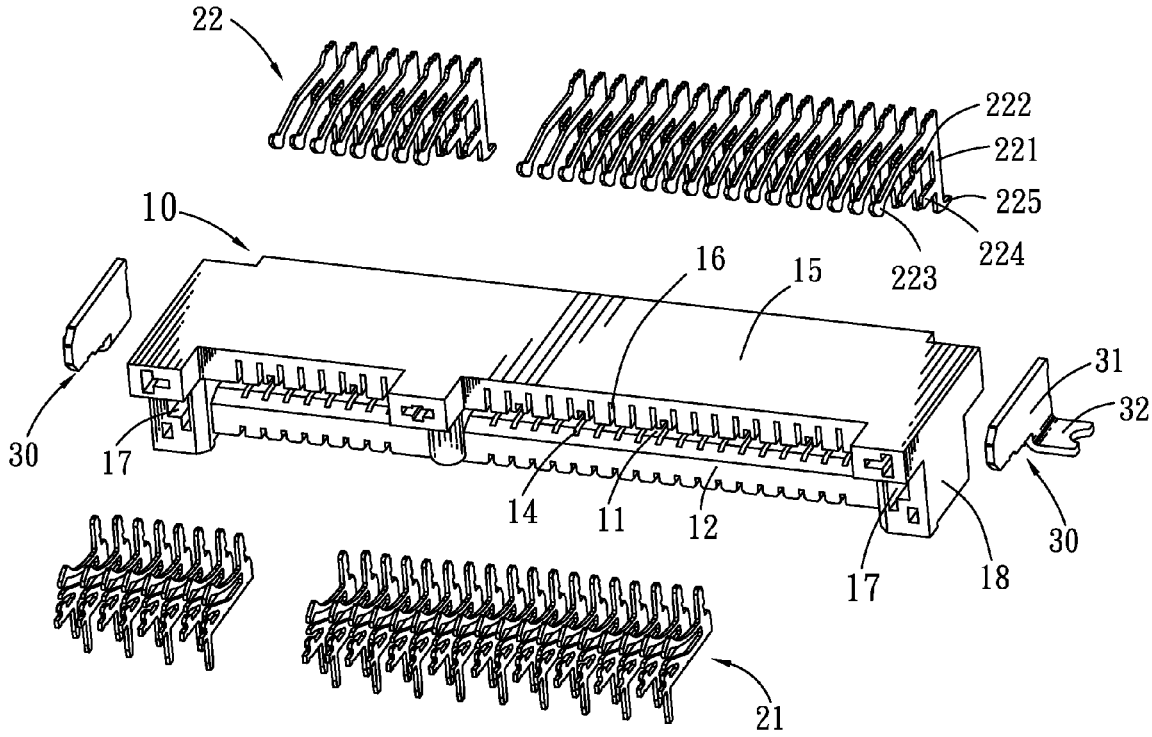
FIG. 2 is an exploded perspective view of the card connector shown in FIG. 1.

Referring to FIGS. 1-2, a card connector in accordance with an embodiment of the present invention includes an insulating housing 10, a plurality of first electrical terminals 21 and second electrical terminals 22 mounted in the insulating housing 10, and two fastening members 30 mounted to two opposite ends of the insulating housing 10.

Figure 3:
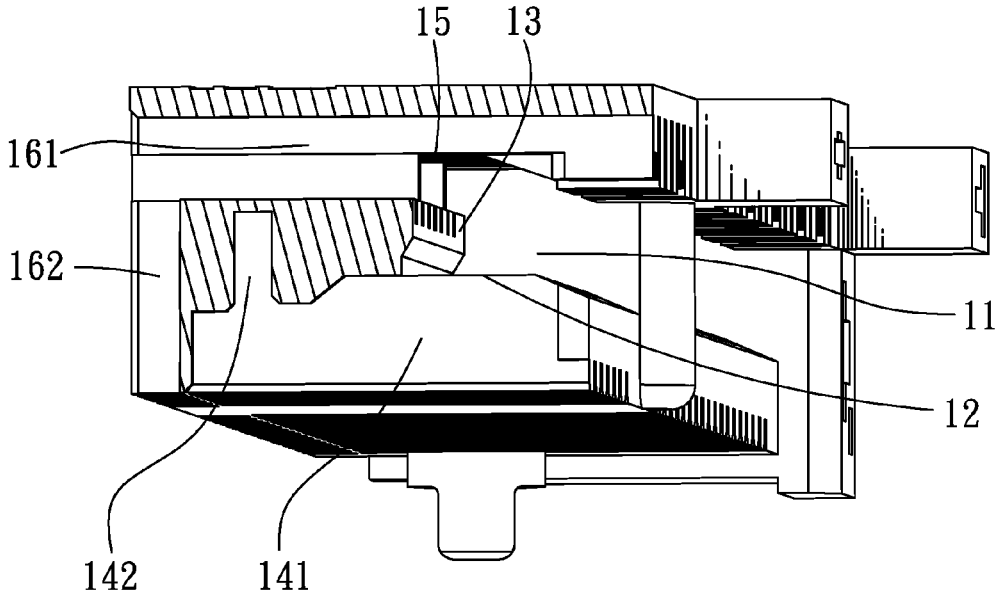
FIG. 3 is a perspective sectional view of an insulating housing of the card connector of FIG. 2.

With reference to FIGS. 2-3, the insulating housing 10 of a long rectangular shape has a front side thereof recessed rearward to form a card recess 11 extending horizontally for receiving an electronic card (not shown). Accordingly, a bottom wall 12, a rear wall 13, a top wall 15 and a pair of side walls 18 are formed around the card recess 11. The bottom wall 12 defines a plurality of first terminal fillisters 14 arranged at regular intervals along a transverse direction thereof. Each first terminal fillister 14 includes a first receiving fillister 141 vertically penetrating through the bottom wall 12 to communicate with the card recess 11 and further spread rearward to the rear wall 13, and a first fixing fillister 142 vertically opened in the rear wall 13 to connect with a rear end of the first receiving fillister 141. The top wall 15 defines a plurality of second terminal fillisters 16 arranged at regular intervals along a transverse direction thereof. Each of the second terminal fillisters 16 includes a second receiving fillister 161 communicating with the card recess 11 and further extending rearward to penetrate through the rear wall 13, and a second fixing fillister 162 vertically opened in a rear side of the rear wall 13 to connect with a rear end of the second receiving fillister 161. Each of the side walls 18 defines a holding recess 17 extending a front-to-rear direction thereof. A rear end of the holding recess 17 further penetrates through a bottom of the side wall 18.

Figure 4:
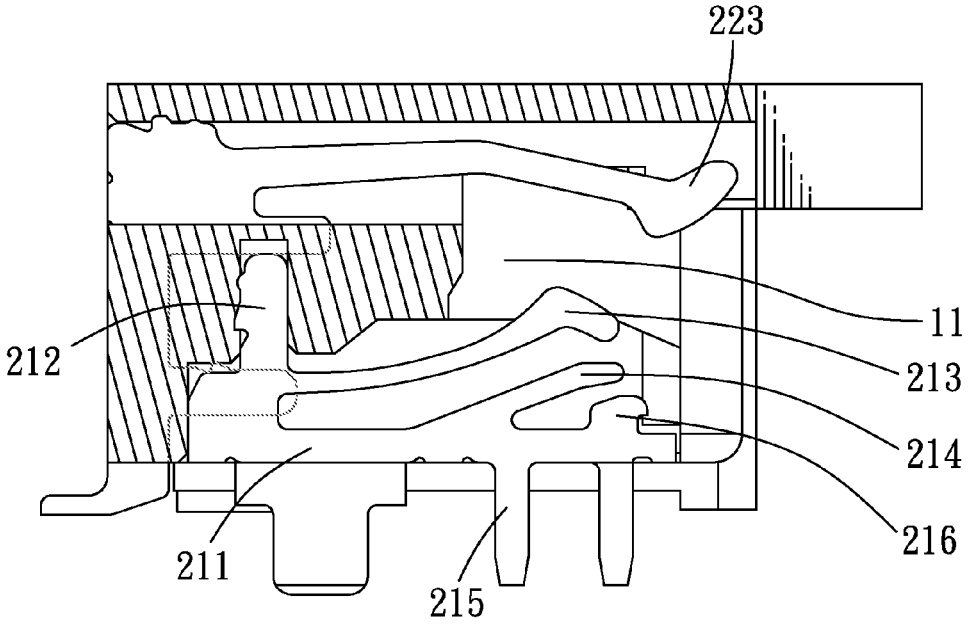
FIG. 4 is a cross-sectional view of the card connector of FIG. 1.

Referring to FIGS. 2-4, the first electrical terminals 21 are disposed in the first terminal fillisters 14 of the insulating housing 10 respectively. The first electrical terminal 21 has a base strip 211 extending along a front-to-rear direction, a first fixing arm 212 extending upward from a rear end of the base strip 211, a first elastic arm 213 extending forward from a lower portion of the first fixing arm 212 and inclined upward in the process of extending forward with a distal end thereof slightly bending downward, a second elastic arm 214 slantwise extending forward and upward from a substantial middle of the base strip 211 with a distal end thereof apart located under that of the first elastic arm 213, a contact portion 216 protruding upward from a front end of the base strip 211 and apart located under the distal end of the second elastic arm 214, and a soldering arm 215 protruding downward from a front of the base strip 211. The base strip 211 of the first electrical terminal 21 is held in the first receiving fillister 141 of the insulating housing 10, and an upper portion of the first fixing arm 212 is inserted in the first fixing fillister 142. The first elastic arm 213, the second elastic arm 214 and the contact portion 216 are accommodated in the first receiving fillister 141, with the distal end of the first elastic arm 213 elastically stretching into the card recess 11. The soldering arms 215 project beyond a bottom side of the bottom wall 12 in a way of alternative arrangement.

The second electrical terminals 22 are disposed in the second terminal fillisters 16 of the insulating housing 10 respectively. The second electrical terminal 22 has a long-strip shaped base slice 221 extending vertically, a third elastic arm 223 extending forward from a top end of the base slice 221 and then inclined downward with a distal end thereof slightly bending upward, a second fixing arm 222 extending forward from an upper portion of the base slice 221 and apart located under the third elastic arm 223, a fastening arm 224 protruding forward from a lower portion of the base slice 221, and a soldering tail 225 bent rearward from a bottom end of the base slice 221. The base slice 221 of the second electrical terminal 22 is fixed in the second fixing fillister 162 of the insulating housing 10 with the soldering tail 225 projecting out of the second terminal fillister 16, the third elastic arm 223 is accommodated in the second receiving fillister 161 with the distal end thereof elastically stretching into the card recess 11 to resist against the electronic card, and the second fixing arm 222 is held in a bottom of the second receiving fillister 161 opened in the rear wall 13. The fastening arm 224 is inserted forward into the rear wall 13 to secure the second electrical terminal 22 in the insulating housing 10.

Referring to FIG. 1 and FIG. 2, each fastening member 30 has a holding plate 31 held in the holding recess 17 of the insulating housing 10. A rear end of a bottom edge of the holding plate 31 extends sideward to form a soldering foot 32 projecting outside the insulating housing 10.

As described above, in use, the electronic card is inserted into the card recess 11 of the insulating housing 10 and presses the distal end of the first elastic arm 213 of the first electrical terminal 21 downward to resist against the distal end of the second elastic arm 214, so as to drive the distal end of the second elastic arm 214 to contact with the contact portion 216. So, an electrical connection is realized between the electronic card and the contact portion 216 via the first elastic arm 213 and the second elastic arm 214, and a short disconnection is avoided happening between the electronic card and the first electrical terminal 21 on account of strong normal contact forces of the first elastic arm 213 and the second elastic arm 214 stood together even if the card connector is shaken or the electronic card is pulled out of the card connector.

What is claimed is:

1. A card connector adapted for receiving an electronic card, comprising:

an insulating housing having a front side thereof recessed rearward to form a card recess for receiving the electronic card therein, the insulating housing defining a plurality of first terminal fillisters and a plurality of second terminal fillisters communicating with the card recess;

a plurality of first electrical terminals each having a base strip extending along a front-to-rear direction, a first fixing arm extending upward from a rear end of the base strip, a first elastic arm extending forward from a lower portion of the first fixing arm and inclined upward in the process of extending forward with a distal end thereof bending downward, a second elastic arm slantwise extending forward and upward from a substantial middle of the base strip with a distal end thereof apart located under that of the first elastic arm, a contact portion protruding upward from a front end of the base strip and apart located under the distal end of the second elastic arm, and a soldering arm protruding downward from a front of the base strip, wherein the base strip and an upper portion of the first fixing arm are held in the first terminal fillister, the first elastic arm, the second elastic arm and the contact portion are accommodated in the first terminal fillister with the distal end of the first elastic arm elastically stretching upward into the card recess, the soldering arms project outside the insulating housing; and a plurality of second electrical terminals disposed in the second terminal fillisters of the insulating housing respectively, each of the second electrical terminals having a third elastic arm of which a distal end projects downward into the card recess to resist against the electronic card, wherein the electronic card inserted in the card recess presses the distal end of the first elastic arm of the first electrical terminal downward to resist against the distal end of the second elastic arm, so as to drive the distal end of the second elastic arm to contact with the contact portion.

2. The card connector as claimed in claim 1, wherein a bottom wall, a rear wall and a top wall are formed around the card recess of the insulating housing, the first terminal fillister includes a first receiving fillister vertically penetrating through the bottom wall to communicate with the card recess and further spread rearward to the rear wall, and a first fixing fillister vertically opened in the rear wall to connect with a rear end of the first receiving fillister, the base strip of the first electrical terminal is held in the first receiving fillister and the upper portion of the first fixing arm is inserted in the first fixing fillister, the first elastic arm, the second elastic arm and the contact portion are accommodated in the first receiving fillister.

3. The card connector as claimed in claim 2, wherein the soldering arms project downward out of the first receiving fillisters and are arranged in a way of alternative arrangement.

4. The card connector as claimed in claim 1, wherein each of the second electrical terminals has a base slice extending vertically, the third elastic arm extends forward from a top end of the base slice and then is inclined downward with a distal end thereof bending upward, a second fixing arm extends forward from an upper portion of the base slice and is apart located under the third elastic arm, a bottom end of the base slice is bent rearward to form a soldering tail, the base slice and the second fixing arm are held in the second terminal fillister of the insulating housing with the soldering tail projecting outside of the insulating housing, the third elastic arm is accommodated in the second terminal fillister.

5. The card connector as claimed in claim 4, wherein a bottom wall, a rear wall and a top wall are formed around the card recess of the insulating housing, each of the second terminal fillisters includes a second receiving fillister opened in the top wall to communicate with the card recess and further extending rearward to penetrate through the rear wall, and a second fixing fillister vertically opened in a rear side of the rear wall to connect with a rear end of the second receiving fillister, the base slice of the second electrical terminal is fixed in the second fixing fillister, the third elastic arm is accommodated in the second receiving fillister, and the second fixing arm is held in a bottom of the second receiving fillister opened in the rear wall.

6. The card connector as claimed in claim 5, wherein a lower portion of the base slice protrudes forward to form a fastening arm inserted forward in the rear wall.

7. The card connector as claimed in claim 1, further comprising two fastening members mounted to two opposite ends of the insulating housing, the fastening member having a holding plate held in the insulating housing, a rear end of a bottom edge of the holding plate extending sideward to form a soldering foot projecting outside the insulating housing.

* * * * *